US006015086A

United States Patent [19]

Ritchie et al.

[11] Patent Number: 6,015,086

[45] Date of Patent: Jan. 18, 2000

[54] WHIP WITH A BRAIDED HANDLE AND METHOD OF FABRICATION

[76] Inventors: Steven D. Ritchie, 368 Bay Plz., Treasure Island, Fla. 33706; Harlie David Reynard, 5054 Johns Pass Ave., Madera Beach, Fla. 33708

[21] Appl. No.: 09/109,720

[22] Filed: Jul. 2, 1998

[51] Int. Cl.[7] ..... B68B 11/00

[52] U.S. Cl. ..... 231/2.5; 428/32

[58] Field of Search ..... 428/32; 231/2.5, 231/5, 6; 87/8

[56] References Cited

U.S. PATENT DOCUMENTS 4,170,921 10/1979 Repass ..... 87/8

*Primary Examiner*—Alexander Thomas

[57] ABSTRACT

A whip with a braided handle and method of fabrication which includes a generally cylindrical handle portion. The handle portion has an inboard end and an outboard end and is fabricated of a braided rope construction which comprises a plurality of single yarns twisted together to form a plurality of piled yarns which are then braided, with a helical angle of the twist of the single yarns within their respective plied yarn being equal and opposite to the helical angle of the plied yarns in the braid. Also included is an inboard first thread which is wrapped circumferentially about the handle end from adjacent the inboard end and extends outboardly. An outboard second thread is wrapped circumferentially around the handle portion to provide a handle. A whipping portion extends outboardly of the outboard end of the handle portion and is fabricated of extensions of the braided strands from the handle portion but in an unbraided braid form.

7 Claims, 2 Drawing Sheets

WHIP WITH A BRAIDED HANDLE AND METHOD OF FABRICATION

BACKGROUND OF THE INVENTION

1. Field of the Invention

The present invention relates to a whip with a braided handle and method of fabrication and more particularly pertains to fabricating whips with a braided handle portion and unbraided portion.

1. Description of the Prior Art

The use of whips of known designs and configurations is known in the prior art. More specifically, whips of known designs and configurations heretofore devised and utilized for the purpose of fabricating whips by known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,170,921 to Repass discloses a Braided Rope. U.S. Pat. No. 3,105,243 to Kampfe et al. discloses a Tassel Construction. U.S. Pat. No. Des. 205,495 to Silverman discloses a Tassel. U.S. Pat. No. Des. 284,487 to Pratt discloses an Aural/Visual signalling instrument. U.S. Pat. No. Des. 273,342 to Rol discloses a Fur Piece. U.S. Pat. No. 4,786,535 to Young discloses a Pompon. Lastly, U.S. Pat. No. 4,369,215 to Offen et al. discloses a Finger Held Pompon.

In this respect, the whip with a braided handle and method of fabrication according to the present invention substantially departs from the conventional concepts and designs of the prior art, and in doing so provides an apparatus primarily developed for the purpose of fabricating whips with a braided handle portion and unbraided portion.

Therefore, it can be appreciated that there exists a continuing need for a new and improved whip with a braided handle and method of fabrication which can be used for fabricating whips with a braided handle portion and unbraided portion. In this regard, the present invention substantially fulfills this need.

SUMMARY OF THE INVENTION

In view of the foregoing disadvantages inherent in the known types of whips of known designs and configurations now present in the prior art, the present invention provides an improved whip with a braided handle and method of fabrication. As such, the general purpose of the present invention, which will be described subsequently in greater detail, is to fabricate whips with a braided handle portion and unbraided portion which has all the advantages of the prior art and none of the disadvantages.

To attain this, the present invention essentially comprises a new and improved whip. The whip includes a generally cylindrical handle portion. The handle portion is approximately 8 inches in length and about ¾ inch in diameter. The handle portion has an inboard end and an outboard end and is fabricated of a braided rope construction comprising a plurality of single yarns twisted together to form a plurality of piled yarns. The plied yarns are then braided with a helical angle of the twist of the single yarns within their respective plied yarn being equal and opposite to the helical angle of the plied yarns in the braid. Also provided is an inboard first thread wrapped circumferentially about the handle end from adjacent the inboard end and extending outboardly for an axial length of about ¾ of an inch. Additionally provided is an outboard second thread wrapped circumferentially around the handle portion and extending for a length of about ¾ of an inch and provides a handle length of about 6¼ inch between the first and second threads. Lastly provided is a whipping portion which extends outboardly of the outboard end of the handle portion. The whipping portion is fabricated of extensions of the braided strands from the handle portion but in an unbraided braid form and extending for a length of about 16 inches.

There has thus been outlined, rather broadly, the more important features of the invention in order that the detailed description thereof that follows may be better understood and in order that the present contribution to the art may be better appreciated. There are of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved whip with a braided handle and method of fabrication which has all of the advantages of the prior art whips of known designs and configurations and none of the disadvantages.

It is another object of the present invention to provide a new and improved whip with a braided handle and method of fabrication which may be easily and efficiently manufactured and marketed.

It is further object of the present invention to provide a new and improved whip with a braided handle and method of fabrication which is of durable and reliable construction.

An even further object of the present invention is to provide a new and improved whip with a braided handle and method of fabrication which is susceptible of a low cost or manufacture with regard to both materials and labor, and which accordingly is then susceptible of low prices of sale to the consuming public, thereby making such whip with a braided handle and method of fabrication economically available to the buying public.

Even still another object of the present invention is to provide a whip with a braided handle and method of fabrication for a whip with a braided handle and method of fabrication Lastly, it is an object of the present invention to provide a new and improved whip with a braided handle and method of fabrication which includes a generally cylindrical handle portion. The handle portion has an inboard end and an outboard end and is fabricated of a braided rope construction which comprises a plurality of single yarns twisted together to form a plurality of piled yarns which are then braided, with a helical angle of the twist of the single yarns within their respective plied yarn being equal and opposite to the helical angle of the plied yarns in the braid. Also included is an inboard first thread which is wrapped circumferentially about the handle end from adjacent the inboard end and extends outboardly. An outboard second thread is wrapped circumferentially around the handle portion to provide a handle. A whipping portion extends outboardly of the outboard end of the handle portion and is fabricated of extensions of the braided strands from the handle portion but in an unbraided braid form.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
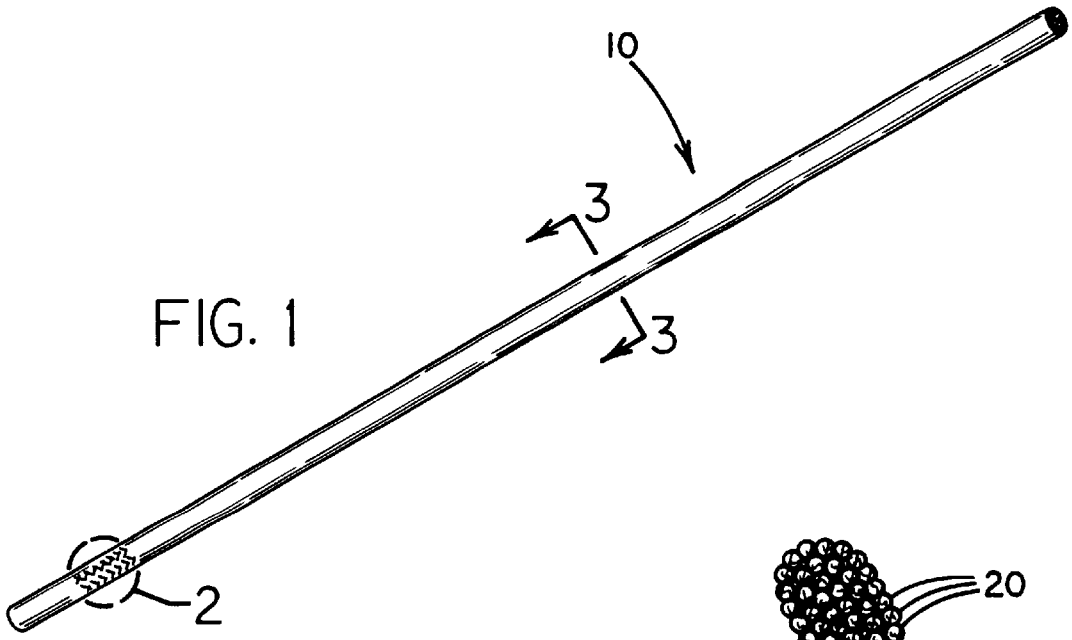
FIG. 1 is a perspective view of a braided rope prior to being fabricated into the whip or whips of the present invention.
Figure 3:
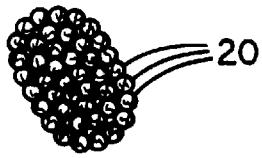
FIG. 3 is a cross-sectional view taken at line 3—3 of FIG. 1.
Figure 2:
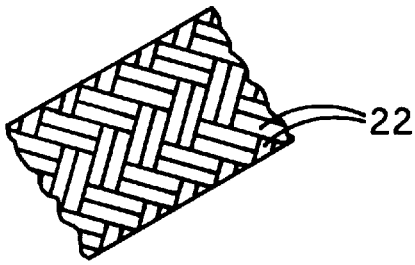
FIG. 2 is an enlarged perspective view taken at circle 2 of FIG. 1.
Figure 4:
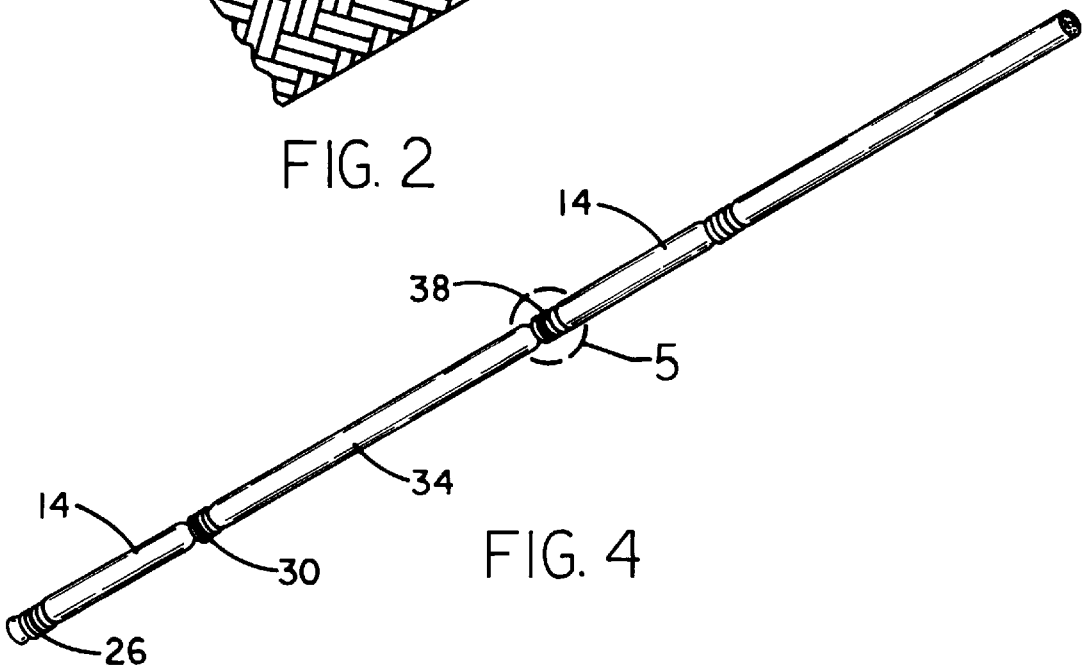
FIG. 4 is a perspective view of the device shown in FIG. 1 but with circumferential threads wrapped therearound.
Figure 5:
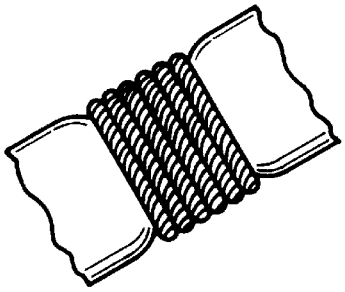
FIG. 5 is an enlarged perspective view taken at circle 5 of FIG. 4.

With reference now to the drawings, and in particular to FIG. 1 thereof, the preferred embodiment of the new and improved whip with a braided handle and method of fabrication embodying the principles and concepts of the present invention and generally designated by the reference numeral 10 will be described.

The present invention, the whip with a braided handle and method of fabrication 10 is comprised of a plurality of components. Such components are individually configured and correlated with respect to each other so as to attain the desired objective.

More specifically, the new and improved whip 10 comprises in combination a generally cylindrical handle portion 12. The handle portion is approximately 8 inches in length and about ¾ inch in diameter. The handle portion has an inboard end 16 and an outboard end 18 and is fabricated of a braided rope construction comprising a plurality of single yarns 20 twisted together to form a plurality of piled yarns 22. The plied yarns are then braided with a helical angle of the twist of the single yarns within their respective plied yarn being equal and opposite to the helical angle of the plied yarns in the braid.

Also provided is an inboard first thread 26 wrapped circumferentially about the handle end from adjacent the inboard end and extending outboardly for an axial length of about ¾ of an inch.

Additionally provided is an outboard second thread 30 wrapped circumferentially around the handle portion and extending for a length of about ¾ of an inch and provides a handle length of about 6¼ inch between the first and second threads.

Lastly provided is a whipping portion 34 which extends outboardly of the outboard end of the handle portion. The whipping portion is fabricated of extensions of the braided strands from the handle portion but in an unbraided braid form and extending for a length of about 16 inches.

The invention also includes the method of fabricating a plurality of whips. The fabrication method includes a plurality of steps. The first step is providing a generally cylindrical handle portion.

The next step involves providing an inboard first thread 36 wrapped around the inboard end of the rope.

Thereafter, the method involves providing a third circumferential thread 38 wrapped around the braiding yarn to constitute a second inboard end 40 of a second whip 42.

Thereafter, the method includes providing a fourth circumferential thread 46.

Figure 6:
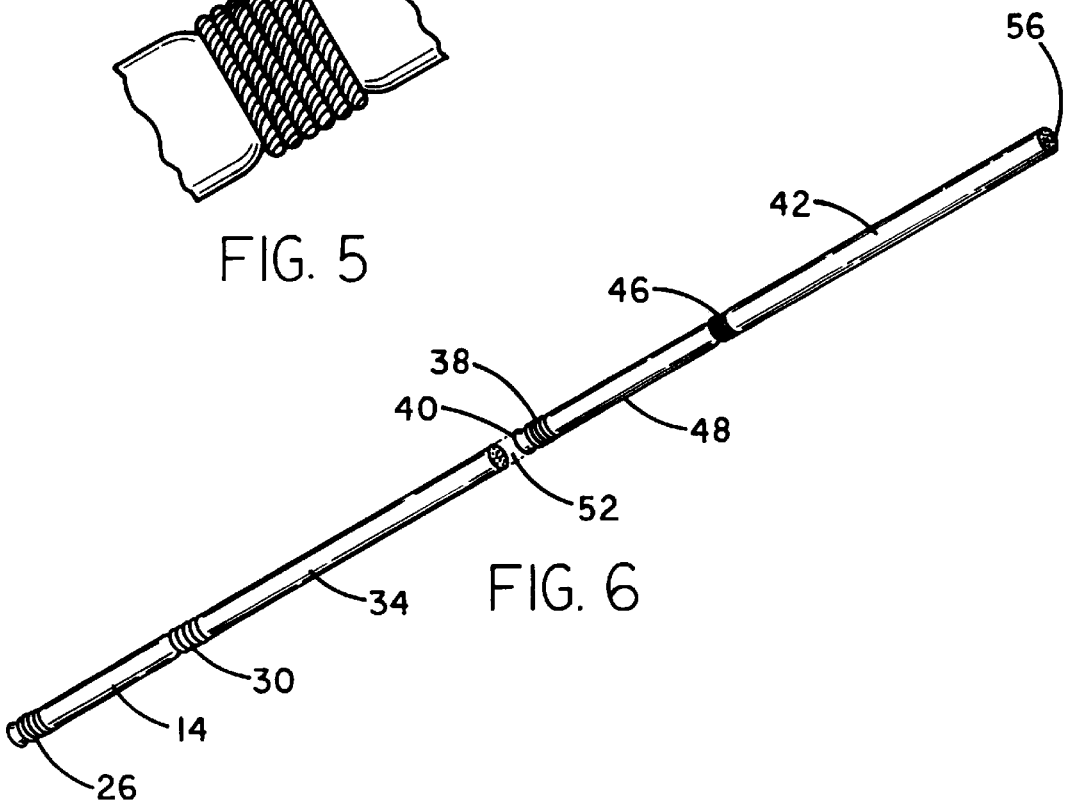
FIG. 6 is a perspective view of the device shown in FIG. 4 after being cut to form a plurality of whips.
Figure 7:
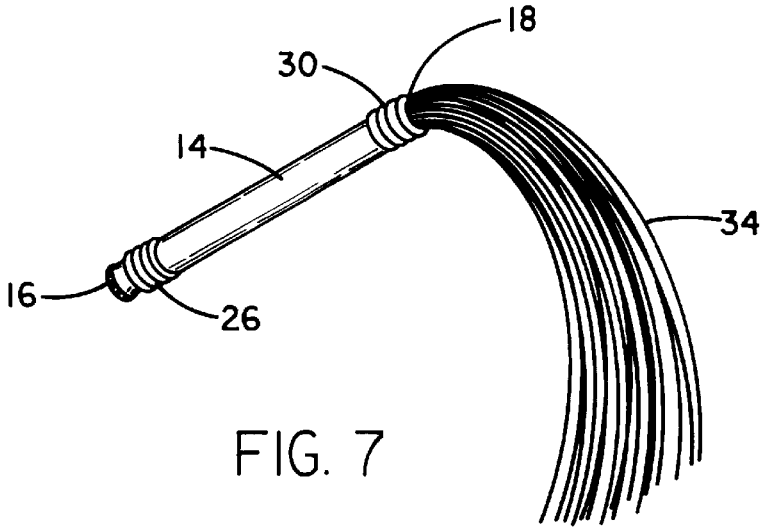
FIG. 7 is a perspective view of one portion of the device shown in FIG. 6 with the whipping portion being frayed.

After the above steps, the method includes radially cutting 52 the braided rope inboardly of the third thread. Note FIG. 6.

Lastly, the method includes fraying the braided rope outboardly end of the second of the second and fourth threads. This forms the whipping portions from the plurality of whip-like strands.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved whip comprising, in combination:

a generally cylindrical handle portion being about 8 inches in length and about ¾ inch diameter, the handle portion having an inboard end and an outboard end and being fabricated of a braided rope construction comprising a plurality of single yarns twisted together to form a plurality of piled yarns which are then braided, with a helical angle of the twist of the single yarns within their respective plied yarn being equal and opposite to the helical angle of the plied yarns in the braid;

an inboard first thread wrapped circumferentially about the handle end from adjacent the inboard end and extending outboardly for an axial length of about ¾ of an inch an outboard second thread wrapped circumferentially around the handle portion and extending for a length of about ¾ of an inch thereby providing a handle length of about 6¼ inch between the first and second threads; and a whipping portion extending outboardly of the outboard end of the handle portion, the whipping portion being fabricated of extensions at the braided strands from the handle portion but in an unbraided braid form and extending for a length of about 16 inches.

2. A whip comprising:

a generally cylindrical handle portion, the handle portion having an inboard end and an outboard end and being fabricated of a braided rope construction comprising a plurality of single yarns twisted together to form a plurality of piled yarns which are then braided, with a helical angle of the twist of the single yarns within their respective plied yarn being equal and opposite to the helical angle of the plied yarns in the braid;

an inboard first thread wrapped circumferentially about the handle end from adjacent the inboard end and extending outboardly;

an outboard second thread wrapped circumferentially around the handle portion thereby providing a handle; and a whipping portion extending outboardly of the outboard end of the handle portion, the whipping portion being fabricated of extensions of the braided strands from the handle portion but in an unbraided braid form.

3. The whip as claimed in claim 2 and further comprising:

a generally cylindrical handle portion being about 8 inches in length and about ¾ inch diameter, the handle portion having an inboard end and an outboard end and being fabricated of a braided rope construction comprising a plurality of single yarns twisted together to form a plurality of piled yarns which are then braided, with a helical angle of the twist of the single yarns within their respective plied yarn being equal and opposite to the helical angle of the plied yarns in the braid.

4. The whip as claimed in claim 2 and further comprising:

an inboard first thread wrapped circumferentially about the handle end from adjacent the inboard end and extending outboardly for an axial length of about ¾ of an inch.

5. The whip as claimed in claim 2 and further comprising:

an outboard second thread wrapped circumferentially around the handle portion and extending for a length of about ¾ of an inch thereby providing a handle length of about 6¼ inch between the first and second threads.

6. The whip as claimed in claim 2 and further comprising:

a whipping portion extending outboardly of the outboard end of the handle portion, the whipping portion being fabricated of extensions of the braided strands from the handle portion but in an unbraided braid form and extending for a length of about 16 inches.

7. A method of fabricating a plurality of whips comprising in combination the steps of:

providing a generally cylindrical portion being about 8 inches in length and about ¾ inch in diameter, a braided rope constructed of a plurality of single yarns twisted together to form a plurality of plied yarns which are then braided, with a helical angle of the twist of the single yarns within their respective plied yarn being equal and opposite to the helical angle of the plied yarns in the braid;

providing an inboard first thread wrapped circumferentially around the handle end from adjacent the inboard end and extending outboardly for an axial length of about ¾ of an inch, the handle thread around the rope at the handle outboard end at a distance of about 7¼ inches from the first strand;

providing a third circumferential thread around the braiding yarn to constitute a second inboard handle end about 2 inches from the first thread to constitute the inboard end of a second whip;

providing a fourth circumferential thread around the braided yarn to constitute a second outboard handle end about 6¼ inches from the third thread to form the second handle therebetween;

radially cutting the braided rope inboardly of the third thread; and fraying the braided rope outboardly of the second and fourth threads to form whipping portions of the second and fourth threads to form whipping portions from the plurality of whip-like strands.

* * * * *